US009320331B1

(12) United States Patent
Gorouvein et al.

(10) Patent No.: US 9,320,331 B1
(45) Date of Patent: Apr. 26, 2016

(54) SWIVEL UMBRELLA SHEATHING HANDLE

(71) Applicants: Edouard Gorouvein, Thornhill (CA); Maksim Gorouvein, Thornhill (CA)

(72) Inventors: Edouard Gorouvein, Thornhill (CA); Maksim Gorouvein, Thornhill (CA)

( * ) Notice: Subject to any disclaimer, the term of this patent is extended or adjusted under 35 U.S.C. 154(b) by 0 days.

(21) Appl. No.: 14/886,277

(22) Filed: Oct. 19, 2015

Related U.S. Application Data

(60) Provisional application No. 62/074,170, filed on Nov. 3, 2014.

(51) Int. Cl.

| | |
|---|---|
| ***A45B 25/00*** | (2006.01) |
| ***A45B 25/24*** | (2006.01) |
| ***A45B 25/26*** | (2006.01) |
| *A45B 19/00* | (2006.01) |

(52) U.S. Cl.
CPC ..... *A45B 25/00* (2013.01); *A45B 25/24* (2013.01); *A45B 25/26* (2013.01); *A45B 2019/002* (2013.01)

(58) Field of Classification Search
CPC ..... A45B 25/00; A45B 25/24
USPC ..... 135/25.4, 25.41
See application file for complete search history.

(56) References Cited

U.S. PATENT DOCUMENTS

| | | | | | |
|---|---|---|---|---|---|
| 1,937,363 | A * | 11/1933 | Seraphim | A45B 25/24 | 135/25.41 |
| 3,935,874 | A * | 2/1976 | Cohen | A45B 11/00 | 135/16 |
| 4,456,023 | A * | 6/1984 | Fujihashi | A45B 19/00 | 135/25.41 |
| 6,334,454 | B1 * | 1/2002 | Williams | A45B 25/24 | 135/18 |
| 2005/0098199 | A1 * | 5/2005 | Ko | A45B 9/02 | 135/25.1 |
| 2005/0166949 | A1 * | 8/2005 | Ko | A45B 25/24 | 135/25.41 |
| 2006/0076374 | A1 * | 4/2006 | Jennings | A45B 25/00 | 224/188 |
| 2010/0212706 | A1 * | 8/2010 | Klose | A45B 25/26 | 135/25.1 |

FOREIGN PATENT DOCUMENTS

| | | | | |
|---|---|---|---|---|
| IT | WO 9636251 | A1 * | 11/1996 | A45B 25/24 |

* cited by examiner

*Primary Examiner* — Noah Chandler Hawk
(74) *Attorney, Agent, or Firm* — Nadya Reingand

(57) ABSTRACT

The present invention is related to road accessories, in particular, to umbrellas and especially to the folding ones. The proposed umbrella has a sheath connected by a joint, with a fixing device, to a shaft connected to a system of ribs and a canopy.

12 Claims, 4 Drawing Sheets

SWIVEL UMBRELLA SHEATHING HANDLE

CROSS-REFERENCE TO RELATED APPLICATIONS

The current patent application claims priority to U.S. provisional application No. 62/074,170 filed on Nov. 3, 2014.

FIELD OF THE INVENTION

This invention generally relates to the road accessories, in particular, to umbrellas and especially to the folding ones.

BACKGROUND ART

Different umbrella designs are known in the prior art. U.S. Pat. No. 9,055,794 by Edouard and Maksim Gorouvein, the present inventors, discloses an umbrella that is self-storing. The umbrella has a hinged case, the umbrella rod, cupola, and ribs are stored in the hinged case and the rod is connected to the hinged case via rotating joint. The hinged case completely encapsulates the umbrella when closed in its stored position.

U.S. Pat. No. 4,456,023 by Fujihashi discloses a collapsible umbrella with a cap on its end that slide-ably enters and exits a tubular sheathing handle which is water tight when closed.

US Patent Application Publication No. 2010/0,212,706 by Klose discloses a telescoping umbrella design in which the umbrella can telescope in and out of a bottom handle/casing.

WO9748303 by Wright also discloses a telescoping umbrella design in which the umbrella can telescope in and out of a bottom handle/casing.

SUMMARY OF THE INVENTION

The objective of the invention is to improve properties of an umbrella taking into account convenience and comfort through ergonometric requirements, and to create a new fashion trend.

The present invention is an umbrella with a sheath connected by a joint, with a fixing device, to a shaft connected to a system of ribs and a canopy.

BRIEF DESCRIPTION OF THE DRAWINGS

The present invention will now be discussed in further detail below with reference to the accompanying figures in which:

FIG. 5 *a*) shows the sheathing 4 is T-shaped. The umbrella is in a closed position with the canopy 3 between the sheathing 4. FIG. 5 *b*) shows the sheathing 4 sloped in toward the joint 5. The umbrella is in a closed position with the canopy 3 between the sheathing 4. FIG. 5 *c*) shows the sheathing 4 sloping down and away from the joint 5. The umbrella is in a closed position. FIG. 5 *d*) shows the sheathing 4 with a T-shape and with the sheathing 4 sloping away from the joint 5. The umbrella is in an open position and canopy 3 has been rotated along with joint 5 so that canopy 3 is no longer between the sheathing 4. FIG. 5 *e*) show the same umbrella as FIG. 5 *d*) in a closed position. In FIG. 5 *e*) the sheathing 4 is T-shaped and with the sheathing 4 sloping away from the joint 5. The umbrella is in a closed position and canopy 3 has been rotated along with joint 5 so that canopy 3 is between the sheathing 4.

DETAILED DESCRIPTION OF THE PREFERRED EMBODIMENTS

Figure 1:
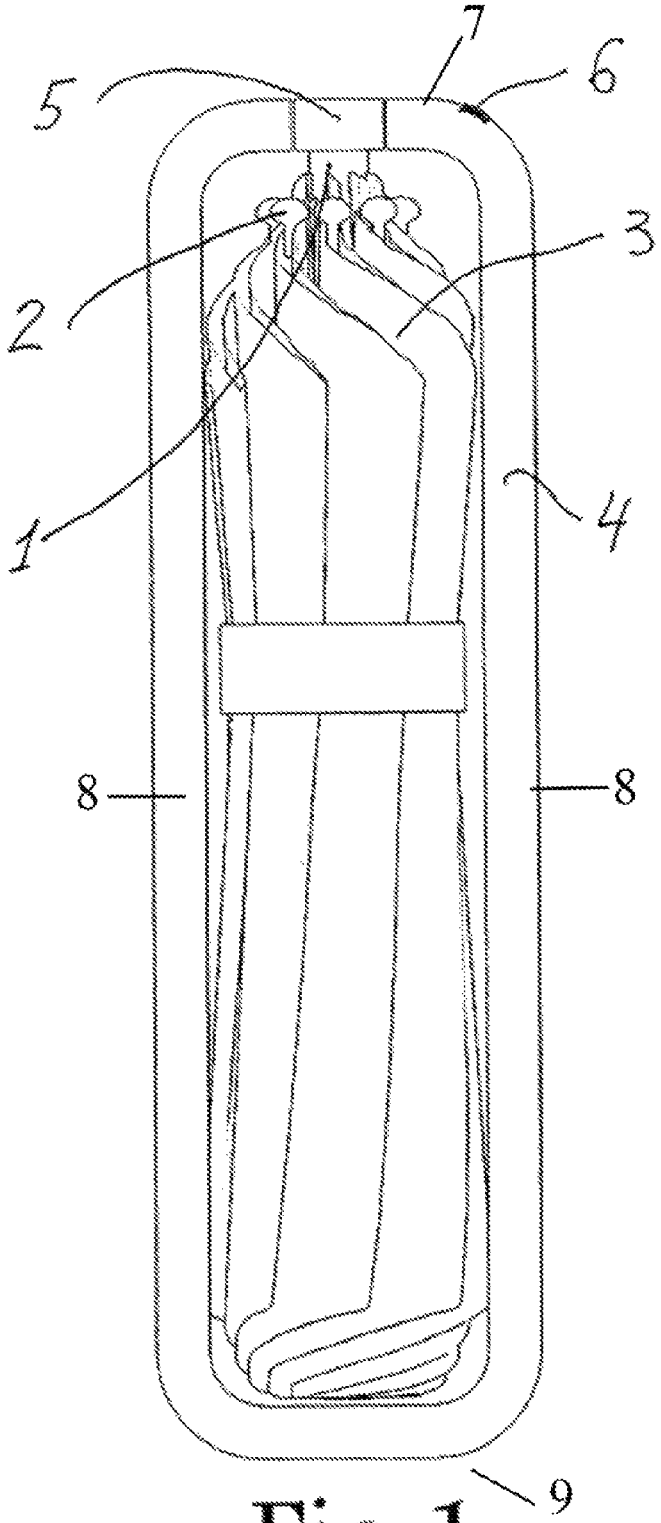
FIG. 1 shows the umbrella in closed state, front view.
Figure 2:
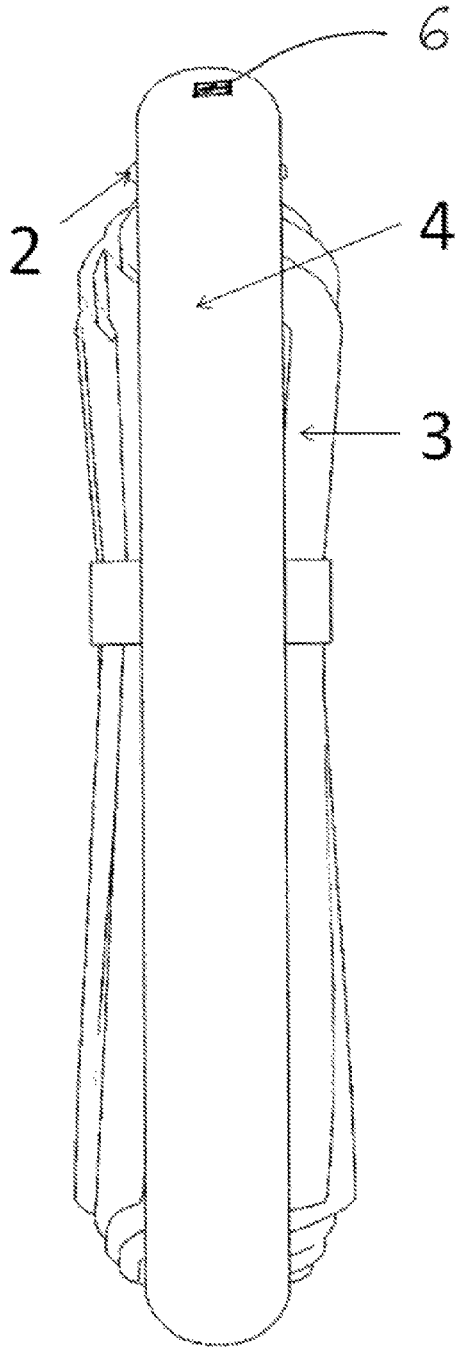
FIG. 2 shows the umbrella in closed state, side view.
Figure 3:
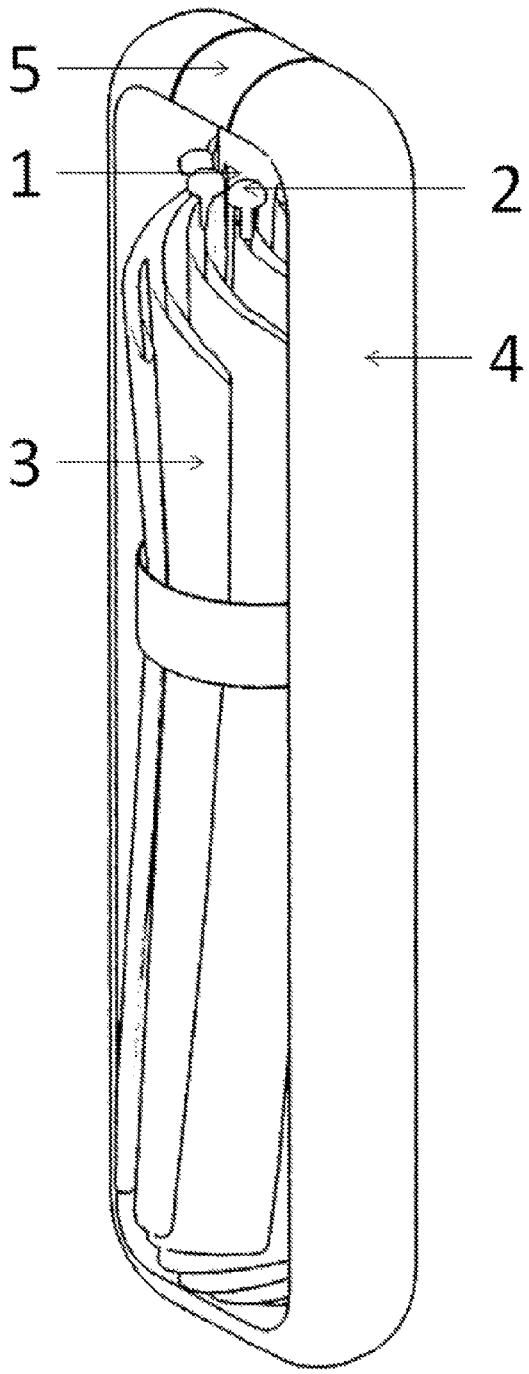
FIG. 3 shows the umbrella in closed state, overall view.
Figure 4:
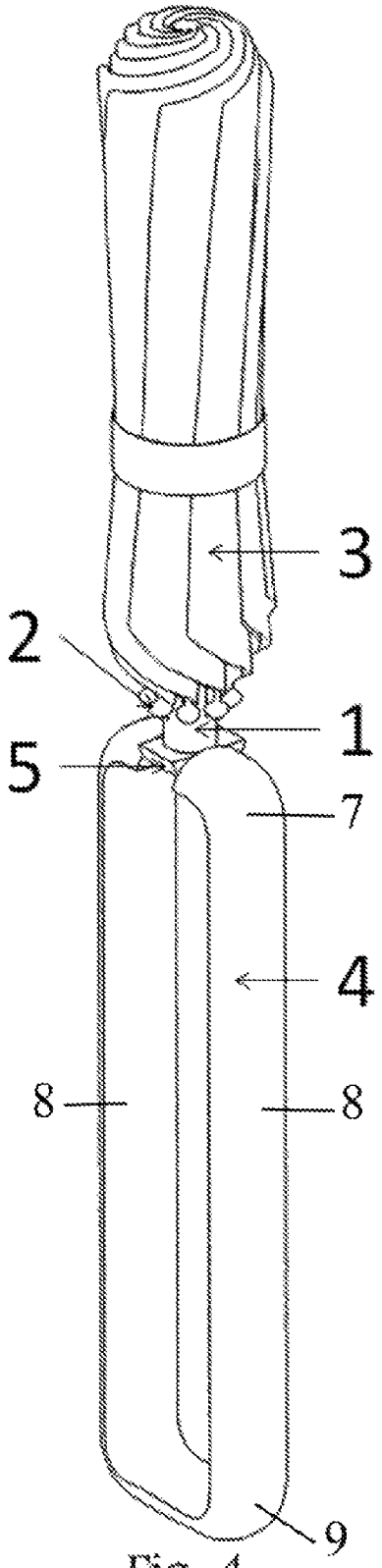
FIG. 4 shows the umbrella in open state, overall view.

Regarding FIGS. 1-5, the umbrella comprises of a shaft (1) with one end being connected to the system of ribs (2), a bearing canopy (3), and a handle in the form of a sheathing portion (4) covering the sides of the umbrella. The sheathing portion being a closed loop having a top (7), sides (8), and a bottom (9). The sheathing (4) is connected to the end of the shaft (1) with the help of a joint (5). The joint (5) is provided with fixing device (6) herewith the shaft of the umbrella (1) fixes the umbrella in the "open" (FIG. 4) and a "closed" state (FIG. 1-3). The joint (5) is a pivotal joint. FIG. 4 shows the joint 5 in the umbrella open state, which is different from the joint position in the closed state (FIG. 1) by 180 degrees. In the open state the umbrella portion, having the shaft, ribs and canopy, is located outside the loop. The joint 5 is located at the top of the sheathing portion. The joint 5 allows rotating the umbrella portion about 360 degrees thus passing through the loon of the sheathing portion.

When opening the umbrella the folded canopy (3) is taken out of the sheathing (4) with the fixing device (6) being released from the "closed" position of the umbrella and turned to an angle of 180 degrees is fixed in the "open" position of the umbrella.

The canopy (3) of the umbrella shall be folded; the folded canopy is released from the fixing device (6) in the "open" position, rotated around the joint (5) to the angle of 180 degrees, put into the sheathing (4), and fixed with a fixing device (6) in the "closed" position. The sheathing (4) has at least one side open so that the canopy (3) can pass in or out during opening or storing of the canopy. The sheathing (4) in FIGS. 1-5 has at least two openings for the canopy (3) to pass through. The shaft (1) is a telescoping shaft allowing for extension or compaction of the umbrella. The sheathing (4) acts as a handle.

Figure 5:
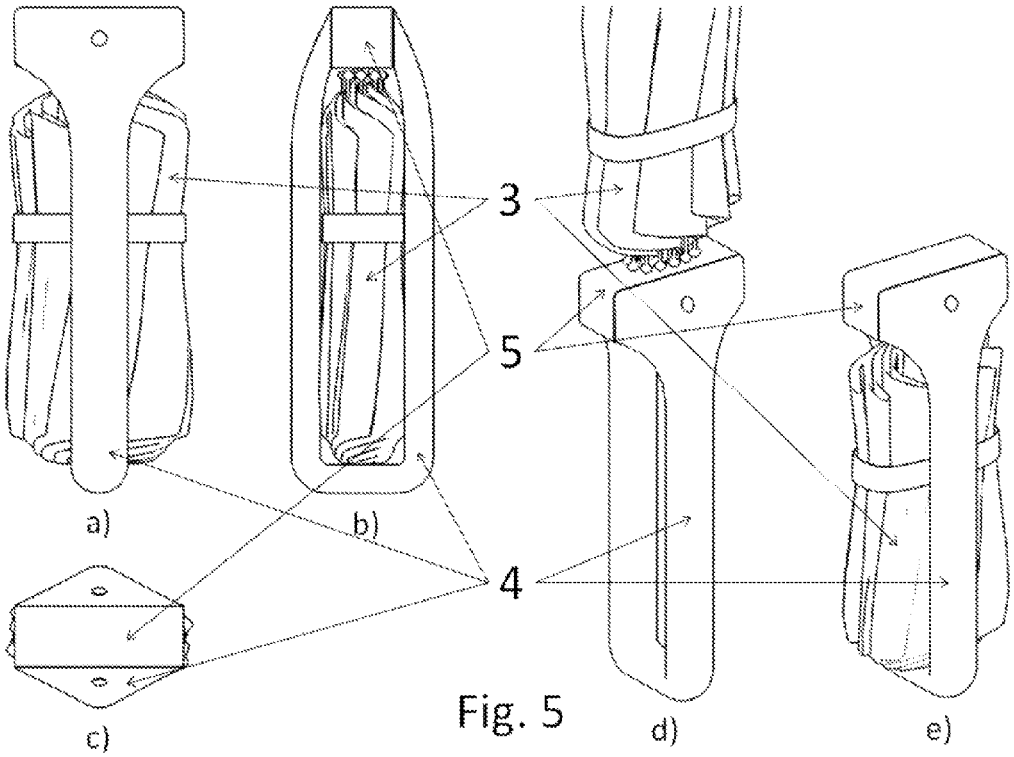
FIG. 5 *a*)-*e*) shows alternative sheathing and joint arrangements.

FIGS. 1-3, 5 *a*)-*c*), and *e*) show the umbrella with pivotal joint in a closed/stored position. FIGS. 4 and 5 *d*) show the umbrella pivotal joint in an open position.

In one embodiment the joint allows moving the shaft of the stored umbrella both clockwise and counterclockwise for achieving the open position. The joint allows circular rotation of the shaft with an ability to fix it in the open and the stored positions.

The description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What is claimed is:

1. An umbrella apparatus, comprising:

a. a shaft, a cupola, and ribs, together forming an umbrella portion;

b. said umbrella portion being connected to a sheathing portion via a pivotal joint between said shaft and said sheathing portion; the sheathing portion being a closed loop having a top, sides, and a bottom; the umbrella portion being connected to the top via a pivotable joint and rotatable about 360 degrees;

c. wherein said sheathing portion is surrounding the umbrella portion when in a closed state, and the umbrella portion is located outside the loon in an open state.

2. The umbrella apparatus of claim 1, wherein the shaft open position differs from the shaft closed position by 180 degrees rotation around the joint.

3. The umbrella apparatus of claim 1, wherein the shaft is a telescopic shaft.

4. The umbrella apparatus of claim 1, wherein the sheathing portion is box-shaped.

5. The umbrella apparatus of claim 1, wherein the sheathing portion is elliptical in shape.

6. The umbrella apparatus of claim 1, wherein the sheathing portion has two open sides.

7. The umbrella apparatus of claim 6, wherein the stored umbrella easily passes through the sheating portion.

8. The umbrella apparatus of claim 7, wherein the joint allows moving the shaft of the stored umbrella clockwise and counterclockwise for achieving the open position.

9. The umbrella apparatus of claim 1, wherein the sheathing portion has more than one open side.

10. A method of connecting a sheathing portion handle with an umbrella, comprising:

a. coupling a shaft of an umbrella portion via a pivotal joint with a sheathing portion that has at least one side such that the umbrella portion can pass in or out of the sheathing portion when the umbrella is opened or stored; the sheathing portion being a closed loop having a top, sides, and a bottom; the umbrella portion being connected to the top via a pivotable joint and rotatable about 360 degrees;

b. wherein the umbrella portion pivots around the pivotal joint for opening the umbrella portion and storing the umbrella portion in the sheathing portion; the umbrella portion being located outside the loop in an open state;

c. wherein said sheathing portion serves both as a storage means when in a closed position and as a handle when in an open position.

11. The method of claim 10, further comprising extending and retracting said shaft telescopically.

12. The method of claim 10, wherein the umbrella storing is performed by rotating the shaft by 180 degrees around the joint.

* * * * *